US009903057B2

(12) United States Patent
Hayashi et al.

(10) Patent No.: US 9,903,057 B2
(45) Date of Patent: Feb. 27, 2018

(54) BULKINESS RECOVERY APPARATUS AND BULKINESS RECOVERY METHOD FOR NONWOVEN FABRIC

(71) Applicant: UNICHARM Corporation, Ehime (JP)

(72) Inventors: Tomoki Hayashi, Kagawa (JP); Hidetaka Oyama, Kagawa (JP); Jun Okuda, Kagawa (JP); Satoshi Mitsuno, Kagawa (JP)

(73) Assignee: UNICHARM CORPORATION, Ehime (JP)

( * ) Notice: Subject to any disclaimer, the term of this patent is extended or adjusted under 35 U.S.C. 154(b) by 16 days.

(21) Appl. No.: 15/028,941

(22) PCT Filed: Sep. 22, 2014

(86) PCT No.: PCT/JP2014/075098
§ 371 (c)(1),
(2) Date: Apr. 13, 2016

(87) PCT Pub. No.: WO2015/056532
PCT Pub. Date: Apr. 23, 2015

(65) Prior Publication Data

US 2016/0251780 A1 Sep. 1, 2016

(30) Foreign Application Priority Data

Oct. 18, 2013 (JP) ..... 2013-217207

(51) Int. Cl.
*D06C 7/00* (2006.01)
*D04H 1/54* (2012.01)
*D06C 3/00* (2006.01)

(52) U.S. Cl.
CPC ..... *D06C 7/00* (2013.01); *D04H 1/54* (2013.01); *D06C 3/00* (2013.01)

(58) Field of Classification Search
CPC ... D06C 3/00; D06C 3/06; D06C 7/00; D06C 7/02; D06C 2700/09; D06C 3/026;
(Continued)

(56) References Cited

U.S. PATENT DOCUMENTS 3,061,906 A * 11/1962 Coggin ..... D06C 7/02 26/106
4,312,139 A * 1/1982 Preisler ..... F26B 13/007 239/437

(Continued)

FOREIGN PATENT DOCUMENTS

CN 1371435 A 9/2002
CN 1497086 A 5/2004

(Continued)

OTHER PUBLICATIONS

Written Opinion in International Patent Application No. PCT/JP2014/075098 dated Dec. 22, 2014.

(Continued)

*Primary Examiner* — Amy Vanatta
(74) *Attorney, Agent, or Firm* — Hauptman Ham, LLP

(57) ABSTRACT

There is provided a bulkiness recovery apparatus for nonwoven fabric, the apparatus being for recovering bulkiness of the nonwoven fabric by blowing hot air to heat the nonwoven fabric. The apparatus includes: a conveying section that conveys the nonwoven fabric along a conveying direction, the nonwoven fabric being continuous in the conveying direction; a heating section that heats the nonwoven fabric by blowing the hot air to the nonwoven fabric being conveyed; a width sensor that measures a widthwise dimension of the nonwoven fabric at a position downstream from the heating section in the conveying direction, and that outputs information concerning the widthwise dimension; and a controller that controls at least either one of the heating (Continued)

section and the conveying section based on the information that has been output from the width sensor.

9 Claims, 6 Drawing Sheets

(58) Field of Classification Search
CPC ..... D06C 2700/02; F26B 3/04; F26B 13/06; F26B 13/08; F26B 13/005; F26B 13/108; F26B 13/12; F26B 13/103; F26B 13/104; F26B 3/06; F26B 13/008; F26B 21/06; F26B 21/10; F26B 21/00; D06B 1/02; D06B 1/08; D02J 1/12; D04H 1/54; D04H 1/50
USPC ..... 28/167, 104; 26/106, 92, 97; 68/5 D, 68/5 E; 34/580, 590, 620, 636, 524, 546, 34/549, 550, 554, 556, 560, 561, 573
See application file for complete search history.

(56) References Cited

U.S. PATENT DOCUMENTS 4,494,315 A * 1/1985 Roos ..... F26B 13/10 34/216
4,575,952 A * 3/1986 Bodenan ..... F26B 13/005 34/242
4,591,517 A * 5/1986 Whipple ..... B41F 23/0426 118/665
4,653,396 A * 3/1987 Wennerberg ..... B30B 3/04 100/162 B
5,791,030 A * 8/1998 Aihara ..... B29C 55/08 26/100
7,268,323 B2 * 9/2007 Tomobe ..... B29C 71/02 219/388
2004/0000041 A1 * 1/2004 Harashige ..... B65H 23/0256 26/51
2004/0111848 A1 * 6/2004 Miyamoto ..... A61F 13/15699 28/165
2007/0110894 A1 * 5/2007 Komatsubara ..... F26B 13/10 427/162
2009/0017711 A1 * 1/2009 Dilo ..... D04H 1/46 442/402
2011/0191994 A1 * 8/2011 Takahashi ..... D04H 1/498 28/167
2015/0067996 A1 * 3/2015 Okuda ..... D04H 1/50 26/106
2015/0211157 A1 * 7/2015 Okuda ..... D04H 3/04 442/334

FOREIGN PATENT DOCUMENTS

CN 100390338 C 5/2008
CN 102227528 A 10/2011
DE 3603435 A1 8/1987
DE 10047223 A1 5/2001
JP 2004-137655 A 5/2004
JP 2009-155756 A 7/2009
JP 5102610 B2 12/2012
WO 2010/047292 A1 4/2010
WO 2013/157611 A1 10/2013

OTHER PUBLICATIONS

International Search Report in PCT/JP2014/075098, dated Dec. 22, 2014.

* cited by examiner

BULKINESS RECOVERY APPARATUS AND BULKINESS RECOVERY METHOD FOR NONWOVEN FABRIC

RELATED APPLICATIONS

The present application is a National Phase entry of International Application No. PCT/JP2014/075098, filed Sep. 22, 2014, which claims priority of Japanese Application No. 2013-217207, filed Oct. 18, 2013.

TECHNICAL FIELD

The invention relates to a bulkiness recovery apparatus for nonwoven fabric and a bulkiness recovery method of nonwoven fabric.

BACKGROUND ART

Absorbent articles such as a sanitary napkin, a disposable diaper and the like have been conventionally used. Also, a pet pad, which is a type of such absorbent articles, is commonly used.

In such an absorbent article, a liquid-permeable top sheet is provided at a part which comes into contact with wearer's skin. In recent years, a top sheet having a high liquid drainage has been demanded in terms of reducing stickiness on skin, and bulky nonwoven fabric is suitable for its material.

The foregoing nonwoven fabric is manufactured into a band-like shape in a suitable method such as carding, and subsequently, the nonwoven fabric is wound in rolls and is stored in the form of a web. At the time of use, the web of nonwoven-fabric is brought into the manufacturing line for the absorbent article, and nonwoven fabric is fed out from the web to be used as a material of the top sheet.

On the other hand, when nonwoven fabric is wound in the form of web, the nonwoven fabric on which tension in the winding direction is exerted is being wound, the tension being for preventing the nonwoven fabric from meandering. Accordingly, the nonwoven fabric is usually wound tightly due to the tension. That is, the nonwoven fabric is compressed in the thickness direction, and the bulkiness decreases. In the manufacturing line for the absorbent article, the nonwoven fabric having a low bulkiness is fed out and supplied from the web thereof. That is, such a nonwoven fabric cannot satisfy the foregoing bulkiness demand.

In order to solve this problem, the Patent Literature 1 discloses a bulkiness recovery apparatus which is provided upstream in the manufacturing line for the absorbent article. Specifically speaking, the nonwoven fabric fed out from the web is conveyed in a predetermined conveying path, and the bulkiness recovery apparatus is provided at a predetermined position in the conveying path. Then, the apparatus heats nonwoven fabric whish passing therein by blowing hot air to nonwoven fabric, and thus recovers the bulkiness of the nonwoven fabric. Then, the nonwoven fabric whose bulkiness has recovered is not wound, and is fed out by the apparatus to the next processing apparatus in the manufacturing line.

CITATION LIST

Patent Literature

[Patent Literature 1] Japanese Unexamined Patent Application Publication No. 2004-137655

SUMMARY OF INVENTION

Technical Problem

However, since nonwoven fabric is heated in the bulkiness recovery apparatus, the nonwoven fabric is softened. Accordingly, when tension in the conveying direction is exerted on the nonwoven fabric, the nonwoven fabric is more likely to stretch in the conveying direction. When the nonwoven fabric is stretched, the widthwise dimension of the nonwoven fabric get smaller according to the stretching. In addition, nonwoven fabric often has uneven strength, in other words, it is common that the strength of nonwoven fabric is not uniform through the entire longitudinal length of the nonwoven fabric. In that case, even though the bulkiness recovery apparatus blows hot air through the entire length of the nonwoven fabric under the same conditions, there is a possibility that the widthwise dimension of the nonwoven fabric varies. Accordingly, the tolerance of the widthwise dimension of the nonwoven fabric have to be set larger by the amount corresponding to this variation, which will lead to low yield factor of nonwoven fabric.

The invention has been made in view of the above conventional problems, and an advantage thereof is to suppress the variation in the widthwise dimension of the nonwoven fabric which will occur in a bulkiness recovery apparatus.

Solution to Problem

An aspect of the invention to achieve the above advantage is a bulkiness recovery apparatus for nonwoven fabric, the apparatus being for recovering bulkiness of the nonwoven fabric by blowing hot air to heat the nonwoven fabric, the apparatus including:

a conveying section that conveys the nonwoven fabric along a conveying direction, the nonwoven fabric being continuous in the conveying direction;

a heating section that heats the nonwoven fabric by blowing the hot air to the nonwoven fabric being conveyed;

a width sensor that measures a widthwise dimension of the nonwoven fabric at a position downstream from the heating section in the conveying direction and that outputs information concerning the widthwise dimension; and a controller that controls at least either one of the heating section and the conveying section based on the information that has been output from the width sensor.

Another aspect of the invention to achieve the above advantage is a bulkiness recovery method of nonwoven fabric, the method being for recovering bulkiness of the nonwoven fabric by blowing hot air to heat the nonwoven fabric, the method including:

conveying the nonwoven fabric along a conveying direction, the nonwoven fabric being continuous in the conveying direction;

heating the nonwoven fabric by blowing the hot air to the nonwoven fabric being conveyed; and outputting information concerning a widthwise dimension of the nonwoven fabric by measuring the widthwise dimension, the nonwoven fabric having been heated by the hot air; and adjusting at least either one of the conveying and the heating based on the information.

Other features of this invention will become apparent from the description in this specification and the attached drawings.

Advantageous Effects of Invention

According to the invention, it is possible to suppress the variation in the widthwise dimension of the nonwoven fabric which will occur in a bulkiness recovery apparatus.

DESCRIPTION OF EMBODIMENTS

Figure 1A:
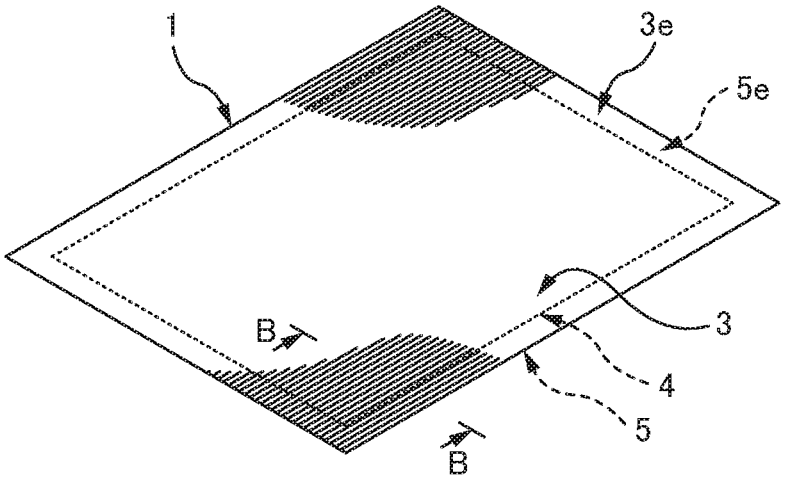
FIG. 1A is a perspective view of a pet pad 1, which is an example of an absorbent article.

At least the following matters will become apparent from the descriptions in the specification and the accompanying drawings.

A bulkiness recovery apparatus for nonwoven fabric, the apparatus being for recovering bulkiness of the nonwoven fabric by blowing hot air to heat the nonwoven fabric, the apparatus including:

a conveying section that conveys the nonwoven fabric along a conveying direction, the nonwoven fabric being continuous in the conveying direction;

a heating section that heats the nonwoven fabric by blowing the hot air to the nonwoven fabric being conveyed;

a width sensor that measures a widthwise dimension of the nonwoven fabric at a position downstream from the heating section in the conveying direction and that outputs information concerning the widthwise dimension; and a controller that controls at least either one of the heating section and the conveying section based on the information that has been output from the width sensor.

With such a bulkiness recovery apparatus for nonwoven fabric, the controller controls at least either one of the heating section and the conveying section based on information concerning the widthwise dimension of the nonwoven fabric, the information having been output from the width sensor. This makes it possible to suppress the variation in the widthwise dimension of the nonwoven fabric.

For example, if the controller controls the conveying section to decrease the conveying speed value at which the nonwoven fabric being conveyed in the heating section, the amount of heat incoming to the nonwoven fabric increases and softening proceeds. Accordingly, adjustment is performed in a direction in which the widthwise dimension decreases due to tension in the conveying direction. If the conveying speed value increases, the amount of incoming heat decreases to suppress the softening. Accordingly, adjustment is performed in a direction in which the widthwise dimension increases.

Similarly, if the controller controls the heating section to increase the temperature of the hot air, the amount of heat incoming to the nonwoven fabric increases and softening proceeds. Accordingly, adjustment is performed in a direction in which the widthwise dimension decreases. On the other hand, if the temperature of the hot air decreases, the amount of incoming heat decreases to suppress the softening. Accordingly, adjustment is performed in a direction in which the widthwise dimension increases.

In such a bulkiness recovery apparatus for nonwoven fabric, it is preferable that the conveying section conveys the nonwoven fabric along a predetermined conveying path, the conveying section includes two driven rollers respectively located in the conveying path at both ends of the heating section in the conveying direction the conveying path, the two driven rollers being driven and rotated for conveying the nonwoven fabric, and the controller changes a circumferential speed value of a driven roller based on the information that has been output from the width sensor, the driven roller being one of the two driven rollers located upstream.

With such a bulkiness recovery apparatus for nonwoven fabric, the circumferential speed value of the driven roller located upstream from the heating section is changed based on the information from the width sensor. This makes it possible to quickly adjust the widthwise dimension of the nonwoven fabric.

For example, if the circumferential speed value of the upstream driven roller is great, the conveying speed value of the nonwoven fabric in the heating section is great. In this case, softening is suppressed, or the tension (in the conveying direction) of the nonwoven fabric in the heating section is mitigated. Accordingly, the widthwise dimension of the nonwoven fabric can increase. On the other hand, if the circumferential speed value is small, the conveying speed value of the nonwoven fabric in the heating section is small. In this case, softening proceeds, or the tension (in the conveying direction) of the nonwoven fabric in the heating section increases. Accordingly, the widthwise dimension of the nonwoven fabric can decrease.

In such a bulkiness recovery apparatus for nonwoven fabric, it is preferable that the controller changes a ratio of a circumferential speed value of one driven roller of the two driven rollers to a circumferential speed value of the other driven roller.

With such a bulkiness recovery apparatus for nonwoven fabric, the controller changes, based on the information, the ratio of the circumferential speed value of one of two driven rollers to the circumferential speed value of the other driven roller. This makes it possible to easily adjust the magnitude of the tension of the nonwoven fabric in the conveying direction when the nonwoven fabric is in the heating section. Consequently, the widthwise dimension of the nonwoven fabric can be reliably adjusted to increase or decrease.

For example, when the ratio is defined as "a value obtained by dividing the circumferential speed value of the upstream one of two driven rollers by the circumferential speed value of the downstream driven roller", if the ratio is great, the tension is small and the widthwise dimension of the nonwoven fabric increases. On the other hand, if the ratio is small, the tension is great and the widthwise dimension decreases. Thus, the widthwise dimension of the nonwoven fabric can be reliably adjusted to increase or decrease.

In such a bulkiness recovery apparatus for nonwoven fabric, it is preferable that a position at which the width sensor measures the widthwise dimension is a position in the conveying path between the heating section and a driven roller, the driven roller being one of the two driven rollers which is located downstream.

With such a bulkiness recovery apparatus for nonwoven fabric, the width sensor measures the widthwise dimension of the nonwoven fabric, and the measurement is performed at a position upstream from one of two driven rollers which is located downstream. Accordingly, the width sensor can substantially avoid measuring the variation in the widthwise dimension due to tension, the tension being exerted in a part of the conveying path which is located more downstream from the foregoing downstream driven roller. This allows the controller to control the heating section and the conveying section surely according only to the variation in the widthwise dimension, the variation having been caused purely by the heating section. This can improve the accuracy of the widthwise dimension.

In such a bulkiness recovery apparatus for nonwoven fabric, it is preferable that based on the information that has been output from the width sensor, the controller controls the heating section so as to change at least either one of a temperature of the hot air and a volume ($m^3$/min.) of the hot air.

With such a bulkiness recovery apparatus for nonwoven fabric, the controller changes, based on the information, at least either one of the temperature of the hot air and the volume ($m^3$/min.) of the hot air. This makes it possible to suppress the variation in the widthwise dimension of the nonwoven fabric. For example, if the controller raises the temperature of the hot air, adjustment is performed in a direction in which the widthwise dimension decreases. On the other hand, if the controller lowers the temperature of the hot air, adjustment is performed in a direction in which the widthwise dimension increases.

In such a bulkiness recovery apparatus for nonwoven fabric, it is preferable that the heating section includes a case member having an inlet of the nonwoven fabric and an outlet of the nonwoven fabric, either one of an inlet-side portion and an outlet-side portion of the case member has a jet inlet, the jet inlet blasting the hot air to an inner space of the case member toward the other one of the inlet-side portion and the outlet-side portion, and the other one of the inlet-side portion and the outlet-side portion has an evacuation opening that evacuates the hot air from the case member, the hot air flowing while being in contact with one of two surfaces of the nonwoven fabric.

With such a bulkiness recovery apparatus for nonwoven fabric, hot air is blasted from the jet inlet so that hot air flows from the one side to the other side in the conveying direction. During flowing from the one side to the other side, hot air heats the nonwoven fabric while being in contact with one of two surfaces of the nonwoven fabric. This makes it possible to surely recover the bulkiness of the nonwoven fabric.

Since hot air flows on the surface of the nonwoven fabric, the nonwoven fabric can be effectively prevented from being compressed in the thickness direction. This makes it possible to smoothly recover bulkiness.

In such a bulkiness recovery apparatus for nonwoven fabric, it is preferable that the bulkiness recovery apparatus further comprises a cooling section that cools the nonwoven fabric by blowing cooling-purpose air to the nonwoven fabric that has been heated by the heating section.

With such a bulkiness recovery apparatus for nonwoven fabric, cooling section blows cooling-purpose air to nonwoven fabric to cool it. This makes it possible to effectively prevent the following phenomenon that will be caused by high temperature of the nonwoven fabric which has been heated by the heating section: a phenomenon that the widthwise dimension of the nonwoven fabric varies because the nonwoven fabric has been softened.

In such a bulkiness recovery apparatus for nonwoven fabric, it is preferable that the cooling section includes a case member having an inlet of the nonwoven fabric and an outlet of the nonwoven fabric, either one of an inlet-side portion and an outlet-side portion of the case member has a jet inlet, the jet inlet blasting the cooling-purpose air to an inner space of the case member toward the other one of the inlet-side portion and the outlet-side portion, and the other one of the inlet-side portion and the outlet-side portion has an evacuation opening that evacuates the air from the case member, the air flowing while being in contact with one of two surfaces of the nonwoven fabric.

With such a bulkiness recovery apparatus for nonwoven fabric, cooling-purpose air is blasted from the jet inlet so that flows from the one side to the other side in the conveying direction. During flowing from the one side to the other side, the air cools the nonwoven fabric while being in contact with one of two surfaces of the nonwoven fabric. This makes it possible to surely cool the nonwoven fabric.

Since cooling-purpose air flows on the surface of the nonwoven fabric, the nonwoven fabric can be effectively prevented from being compressed in the thickness direction. Accordingly, the recovered bulkiness surely avoids being compressed by the cooling-purpose air.

Further, a bulkiness recovery method of nonwoven fabric, the method being for recovering bulkiness of the nonwoven fabric by blowing hot air to heat the nonwoven fabric, the method including:

conveying the nonwoven fabric along a conveying direction, the nonwoven fabric being continuous in the conveying direction;

heating the nonwoven fabric by blowing the hot air to the nonwoven fabric being conveyed;

outputting information concerning a widthwise dimension of the nonwoven fabric by measuring the widthwise dimension, the nonwoven fabric having been heated by the hot air; and adjusting at least either one of the conveying and the heating based on the information.

With such a bulkiness recovery method of nonwoven fabric, at least either one of heating the nonwoven fabric and conveying the nonwoven fabric is adjusted based on information concerning the widthwise dimension of the heated nonwoven fabric. This makes it possible to suppress the variation in the widthwise dimension of the nonwoven fabric.

Embodiment

A bulkiness recovery apparatus 20 and a bulkiness recovery method for nonwoven fabric 3 according to this embodiment are for nonwoven fabric 3 to be used as a top sheet 3 of a pet pad 1.

Figure 1B:
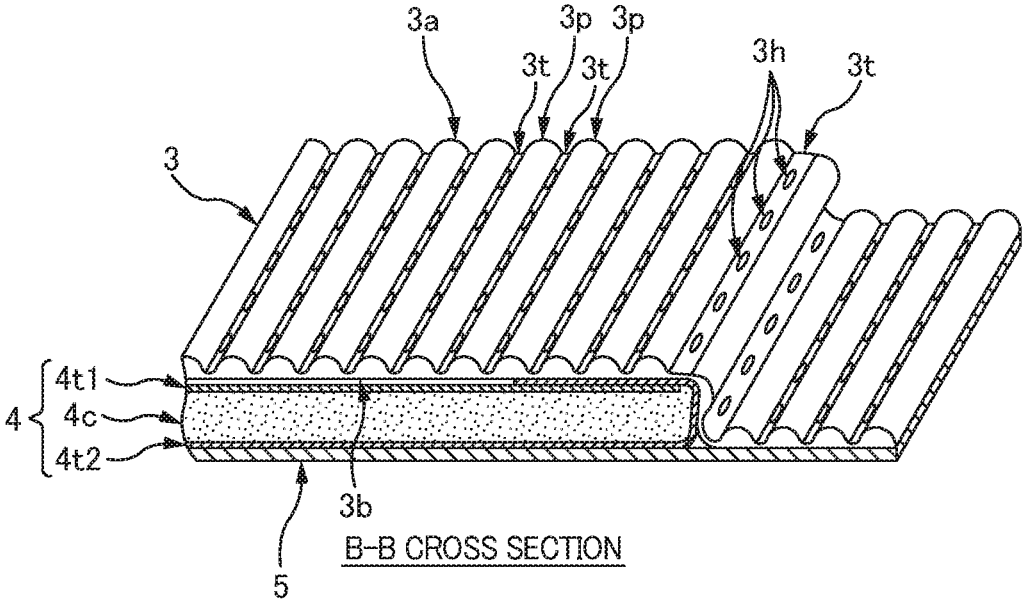
FIG. 1B is a magnified perspective view showing the pet pad 1 which is cut away along line B-B in FIG. 1A.

FIG. 1A is a perspective view of a pet pad 1, which is an example of an absorbent article. FIG. 1B is a magnified perspective view showing the pet pad 1 which is cut away along line B-B in FIG. 1A.

The pet pad 1 is placed on a floor or the like, as shown in FIG. 1A, to be used for disposing of excrement of an animal such as a dog or a cat. The pet pad 1 includes: a liquid-permeable top sheet 3 having a rectangular shape when viewed from above; a liquid-impermeable back sheet 5 having substantially the same shape as the top sheet 3; and a liquid-absorbent absorbent body 4 placed between the sheets 3 and 5, for example. The absorbent body 4 is joined to both of the top sheet 3 and the back sheet 5 with hot-melt adhesive, etc. In parts 3*e* and 5*e* where the top sheet 3 and the back sheet 5 extend toward the sides beyond the absorbent body 4 (the edges 3*e* and 5*e* of sheets 3 and 5), the sheets 3 and 5 are joined with hot-melt adhesive, etc.

As shown in FIG. 1B, the absorbent body 4 includes, for example, an absorbent core 4*c* composed of liquid absorbent fiber (e.g. pulp fiber) and super absorbent polymer (so-called SAP) which are deposited into a substantially rectangular shape as viewed from above. The absorbent core 4*c* may be covered with two liquid-permeable cover sheets 4*t*1 and 4*t*2, such as tissue paper. That is, as in this example, the absorbent core 4*c* is covered with the one cover sheet 4*t*1 from a skin-side surface, and covered with the other cover sheet 4*t*2 from a non-skin-side surface. In some cases, the entire surface of the absorbent core 4*c* may be covered with a single cover sheet.

The back sheet 5 is, for example, film made of material such as polyethylene (PE), polypropylene (PP), polyethylene terephthalate (PET), or the like. However, the invention is not limited thereto. Any liquid-impermeable sheet may be used.

The top sheet 3 is made of the nonwoven fabric 3. In this example, the nonwoven fabric 3 has two surfaces 3*a* and 3*b*; one surface 3*b* is substantially flat, and the other surface 3*a* has a wavy shape. In other words, straight grooves 3*t* and straight protrusions 3*p* are arranged alternatively. The protrusions 3*p*, 3*p*, . . . are made by a well-known process of blowing air (see Japanese Unexamined Patent Application Publication No. 2009-11179, etc.); which existed at positions corresponding to the grooves 3*t* are blown and shifted to be carried onto portions corresponding to the protrusions 3*p*. The interfiber space is large. This makes the nonwoven fabric 3 to be bulky as a whole. In each of the grooves 3*t*, a plurality of through holes 3*h* penetrating in the thickness direction can be provided as in this example.

The average basis weight of the nonwoven fabric 3 is, for example, 10 to 200 (g/m$^2$). The average basis weight at the centers of the protrusions 3*p* is, for example, 15 to 250 (g/m$^2$). The average basis weight at the bottoms of the grooves 3*t* is, for example, 3 to 150 (g/m$^2$).

As a fiber constituting the nonwoven fabric 3, composite fiber having a core-sheath structure of a PET core and a PE sheath is suitable. But, thermoplastic resin fiber except for this may also be used, for example, composite fiber having a core-sheath structure of a PP core and a PE sheath, fibers having side-by-side structure, or single fiber made of one thermoplastic resin.

Further, nonwoven fabric 3 may have crimped fiber, which is fiber having crimped shape such as zigzag shape, Ω-shape, spiral shape or the like.

As the nonwoven fabric 3, nonwoven fabric having a fiber length within a range, for example, between 20 and 100 mm may be used, and also nonwoven fabric having a size, for example, within a range between 1.1 and 8.8 dtex.

Figure 2:
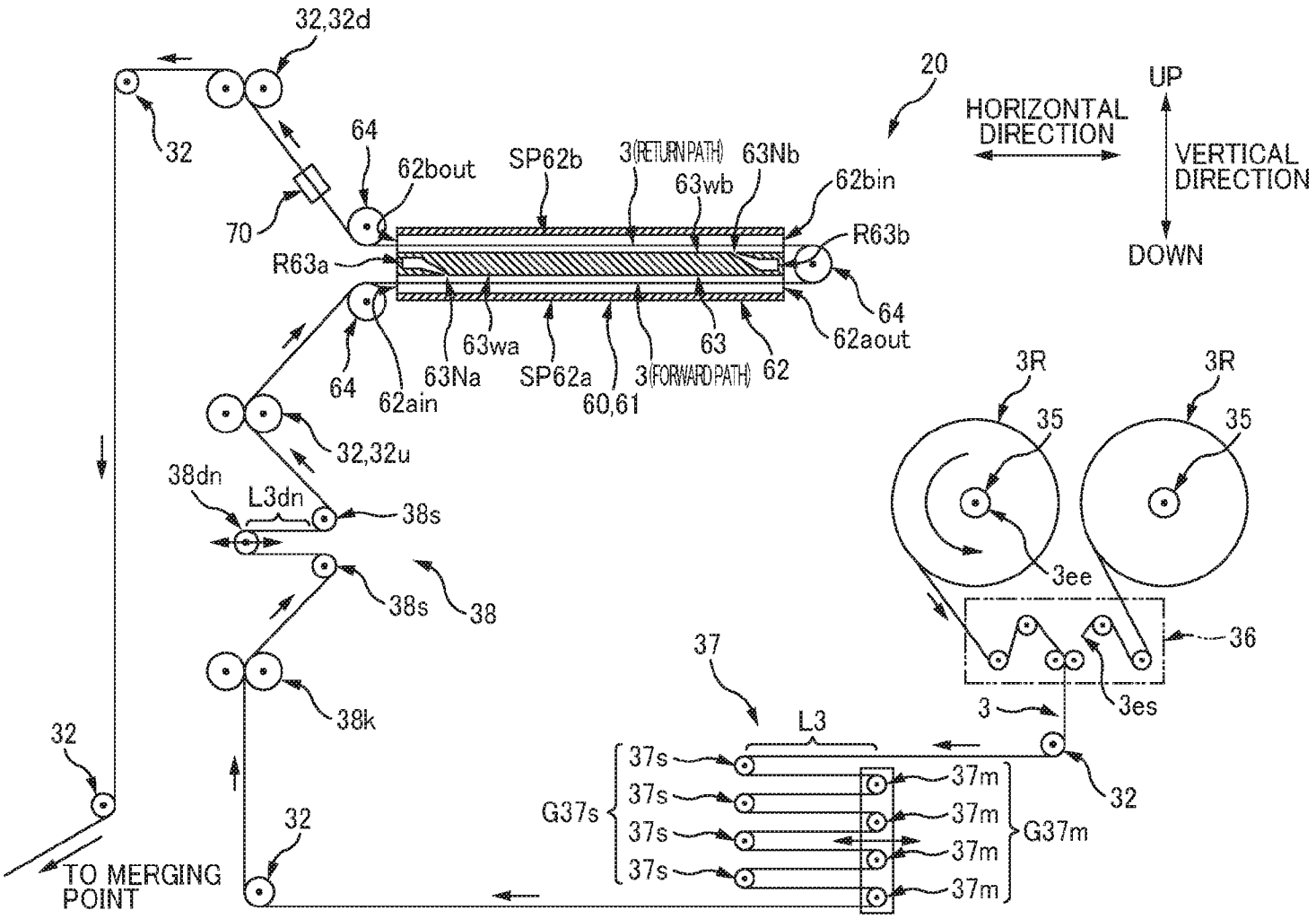
FIG. 2 is a schematic side view of a bulkiness recovery apparatus 20 of this embodiment.

The foregoing pet pad 1 is manufactured in the manufacturing line for the pet pad 1. The nonwoven fabric 3 for the top sheet 3 is brought into the manufacturing line in the form of a web 3R of the nonwoven fabric 3 (FIG. 2). In other words, nonwoven fabric 3 having the protrusions 3*p* is wound in rolls and stored. From the storage, the web 3R of the nonwoven fabric 3 is brought into the manufacturing line for the pet pad 1. Then, the web 3R is attached to a feeding unit 35 installed in the manufacturing line, and is fed out as a material of the top sheet 3.

However, as mentioned above, it is possible that the bulkiness of nonwoven fabric 3 of the web 3R is compressed. A bulkiness recovery apparatus 20 is therefore provided in the manufacturing line.

Figure 3B:
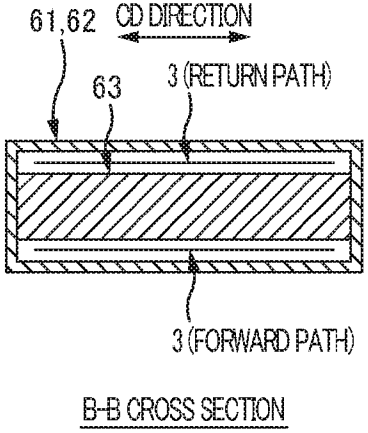
FIG. 3B is a cross sectional view of a heating section 60 taken along line B-B in FIG. 3A.
Figure 3A:
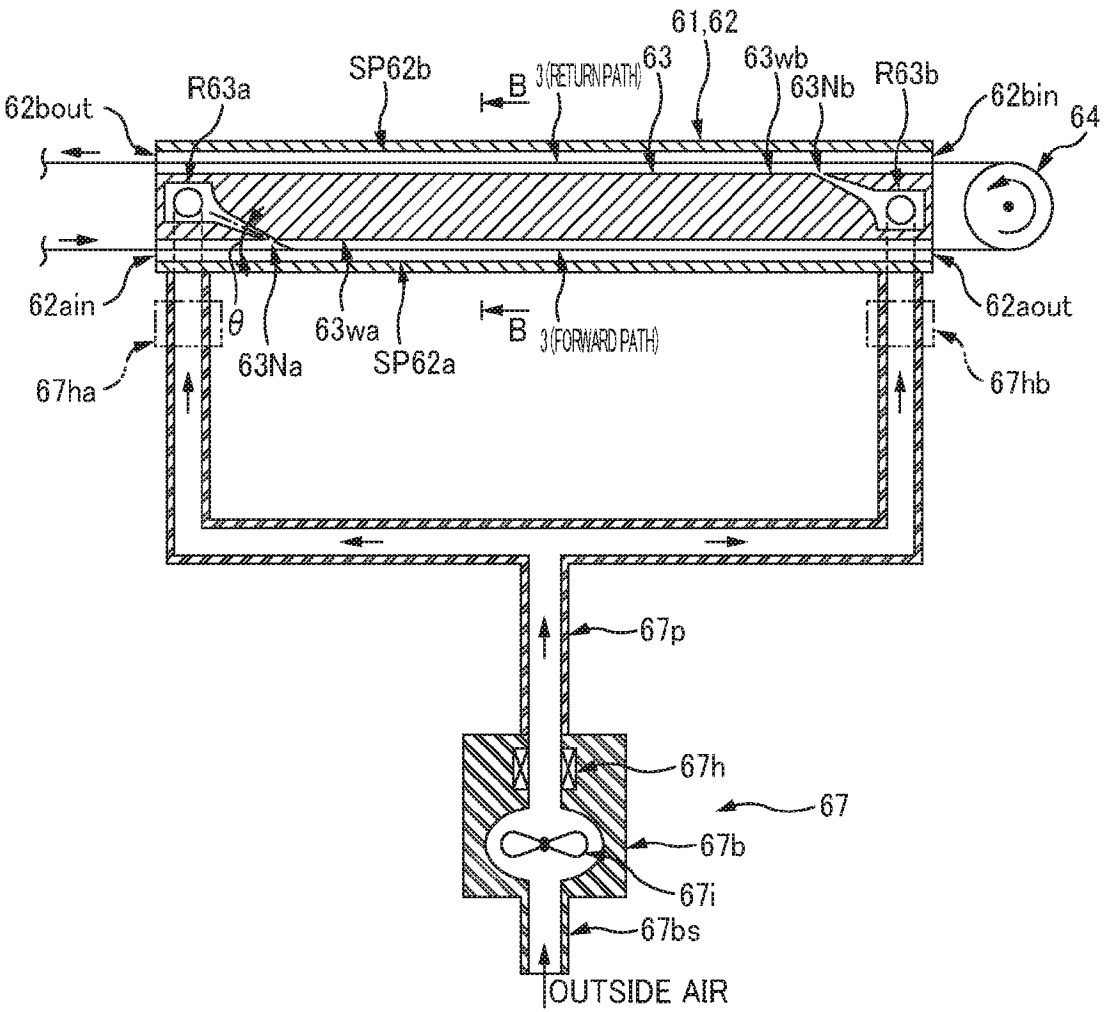
FIG. 3A is a diagram illustrating a heating section 60, which serves as a main part of the bulkiness recovery apparatus 20.

FIG. 2 is a schematic side view of the bulkiness recovery apparatus 20. FIG. 3A is a diagram illustrating a heating section 60, which serves as a main part of the bulkiness recovery apparatus 20. FIG. 3B is a cross sectional view of the heating section 60 taken along line B-B in FIG. 3A. FIGS. 2 and 3A show the cross section of a heating unit 61, which serves as a main part of the heating section 60.

As shown in FIG. 2, the bulkiness recovery apparatus 20 includes: a conveying section 30 that feeds out the nonwoven fabric 3 from the web 3R and conveys the nonwoven fabric 3 along a predetermined conveying path; the heating section 60 that heats the nonwoven fabric 3 at a predetermined position in the conveying path; and a controller (not shown) that controls the conveying section 30 and the heating section 60. The nonwoven fabric 3 the bulkiness of which has recovered by being heated by the heating section 60 is transferred to a merging point with other in-process material of the pet pad 1 (e.g. absorbent body 4), which is located downstream in the conveying direction. Then, the nonwoven fabric 3 is joined to or processed with the in-process material at the merging point.

Like the bulkiness recovery apparatus 20, apparatuses placed in the manufacturing line (not shown) are each supported by a suitable supporting member. In this example, as an example of such a supporting member, a so-called mirror plate (not shown) is used. The mirror plate is a plate vertically installed on the floor of the manufacturing line. The mirror plate has a vertical surface (the normal direction to the surface is in the horizontal direction), and the vertical surface supports the apparatuses, for example, in a cantilevered manner.

The normal direction to the vertical surface is hereinafter referred to as a "CD direction". In FIG. 2, the CD direction is in a direction penetrating the paper plane of FIG. 2. More specifically, the CD direction is one of directions in the horizontal plane and is in a direction penetrating the paper plane of FIG. 2. Since the nonwoven fabric 3 which has been fed out is conveyed basically in a position in which the width direction of the nonwoven fabric 3 is in the CD direction, the conveying direction of the nonwoven fabric 3 is in a direction perpendicular to the CD direction. Such a supporting member is not limited to the mirror plate, and any other supporting member may be used.

The conveying section 30 includes a plurality of conveyor rollers 32, 32, . . . which defines the conveying path of the nonwoven fabric 3. The conveying section 30 also includes: a feeding units 35 and 35; a material-splicing apparatus 36; an accumulator 37; and a tension controller 38. In the conveying path, the units 35, 35, 36, 37, and 38 are arranged in this order from upstream toward downstream in the conveying direction.

The conveyor rollers 32, 32, . . . are respectively supported rotatably around rotation shafts along the CD direction, and thus convey the nonwoven fabric 3 in a position in which the width direction of the nonwoven fabric 3 is in the CD direction.

Some of the conveyor rollers 32, 32, . . . are driven rollers 32*u* and 32*d* which are each driven and rotated by a servo motor as a driving source. The other conveyor rollers 32 are idler rollers which do not have a driving source, that is, rollers which receive rotational force and rotate by being in contact with the nonwoven fabric 3 being conveyed.

The driven rollers 32*u* and 32*d* are respectively provided at positions on both sides of the heating section 60 (precisely speaking, the heating unit 61 to be described later) in the conveying path. The driven roller 32*u* placed upstream in the conveying direction with respect to the heating section 60 is hereinafter referred to as an "upstream conveyor driven roller 32*u*". The driven roller 32*d* placed downstream in the conveying direction with respect to the heating section 60 is hereinafter referred to as a "downstream conveyor driven roller 32*d*". By controlling the rotation operations of the upstream conveyor driven roller 32*u* and the downstream conveyor driven roller 32*d*, a state of the nonwoven fabric 3 which is being conveyed in the heating section 60 is adjusted. This will be described later in detail.

The feeding unit 35 is a unit that feeds out the nonwoven fabric 3 from the web 3R, and has a rotation shaft along the CD direction. The feeding unit 35 supports rotatably the web 3R of the nonwoven fabric 3 around the rotation shaft. The rotation shaft is driven and rotated, for example, by a servo motor (not shown) as a driving source, and the nonwoven fabric 3 is thereby fed out from the web 3R. The servo motor performs the feeding operation in cooperation with the accumulator 37. This will be described later.

As an example of the plurality of the feeding units 35, two feeding units 35 and 35 are provided, and these units are used by basically alternately being switched. That is, the feeding units 35 have the following configuration: while one of the feeding units 35 is feeding the nonwoven fabric 3, the other feeding unit 35 is in a standby status, and when the web 3R of the one feeding unit 35 runs out, the feeding unit 35 which has been in a standby status starts feeding of the nonwoven fabric 3. Since the feeding units 35 are well known, the detailed description thereof will be omitted.

The material-splicing apparatus 36 is an apparatus that splices an edge 3*ee* of the nonwoven fabric 3 of the web 3R with an edge 3*es* of nonwoven fabric 3 of another web 3R, which is attached to the feeding unit 35 in a standby status; the splicing is performed slightly before the feeding unit 35 in feeding operation runs out of a web 3R of the nonwoven fabric 3. Accordingly, the nonwoven fabric 3 can be fed out continuously without interruption. Since the material-splicing apparatus 36 is also well known, the detailed description thereof will be omitted.

The accumulator 37 is an apparatus that accumulates the nonwoven fabric 3 which has been fed out by the feeding unit 35, in a manner capable of feeding the nonwoven fabric 3 toward downstream in the conveying direction. The nonwoven fabric 3 accumulated by the accumulator 37 itself is fed out toward downstream when the nonwoven fabric 3 is not fed out by the feeding unit 35 during a period such as the splicing by the material-splicing apparatus 36. Thus, feeding suspension of the feeding unit 35 does not effect on downstream in the manufacturing line. When feeding suspension of the feeding unit 35 is terminated, the nonwoven fabric 3 is fed out by the feeding unit 35 until a predetermined accumulation amount. The feeding is performed at a speed value (m/min.) which is faster than the speed value (m/min.) at which the nonwoven fabric 3 is being conveyed at a position immediately downstream from the accumulator 37. Thus, the accumulator 37 accumulates an amount corresponding to the nonwoven fabric 3 which has been fed out during feeding suspension.

In this example, the accumulator 37 includes: a fixed-roller group G37*s* consisting of a plurality of rollers 37*s*, 37*s*, . . . fixed at fix positions; and a movable-roller group G37*m* consisting of a plurality of rollers 37*m*, 37*m*, . . . provided in such a manner that the rollers can reciprocally move in the horizontal direction. The nonwoven fabric 3 is alternatively wound around the rollers 37*s* belonging to the fixed-roller group G37*s* and the rollers 37*m* belonging to the movable-roller group G37*m*. The loop L3 of the nonwoven fabric 3 is thereby formed to accumulate the nonwoven fabric 3.

The movable-roller group G37*m* reciprocally moves in the horizontal direction, depending on the magnitude of the tension (N) of the nonwoven fabric 3. That is, when the magnitude of the tension of the nonwoven fabric 3 is greater than a predetermined set value (N) of the tension, the movable-roller group G37*m* moves so that the loop L3 becomes smaller. Thus, the accumulated nonwoven fabric 3 is fed out and is supplied downstream. On the other hand, when the magnitude of the tension of the nonwoven fabric 3 is smaller than the foregoing set value, the movable-roller group G37*m* moves so that the loop L3 becomes larger. Thus, the nonwoven fabric 3 is accumulated. Accordingly, at a position immediately downstream from the accumulator 37, the magnitude of the tension of the nonwoven fabric 3 substantially remains at the foregoing set value. In this point, the accumulator 37 has a function similar to the following tension controller 38. Since the accumulator 37 is well known, the detailed description thereof will be omitted.

The tension controller 38 is provided between the accumulator 37 and the upstream conveyor driven roller 32*u*. The tension controller 38 adjusts the magnitude of the tension of the nonwoven fabric 3(N) so that the magnitude of the tension at a position immediately downstream from the tension controller 38 is a predetermined desired value (N).

The tension controller 38 is configured using a so-called dancer roller 38*dn*. That is, the tension controller 38 includes a pair of fixed rolls 38*s* and 38*s*, a dancer roller 38*dn* and a driven roll 38*k*. The pair of fixed rolls 38*s* and 38*s* are fixed with a space between the rolls in the conveying direction. The dancer roller 38*dn* is provided between the pair of fixed rolls 38*s* and 38*s* and can reciprocally move in a direction perpendicular to the CD direction. The driven roll 38*k* is provided upstream from the dancer roller 38*dn* in the conveying direction. The nonwoven fabric 3 is wound around each of the pair of fixed rolls 38*s* and 38*s*, the dancer roller 38*dn* and the driven roll 38*k*. A part of the nonwoven fabric 3 is wound around the pair of fixed rolls 38*s* and 38*s* and the dancer roller 38*dn*, and the part forms a loop L3*dn*. Force which equals twice the desired value of the tension of the nonwoven fabric 3 is exerted on the dancer roller 38*dn* in a direction of the reciprocal motion in which the loop L3*dn* becomes larger. Accordingly, if the magnitude of the tension of the nonwoven fabric 3 is greater than the desired value, the dancer roller 38*dn* moves so that the loop L3*dn* becomes smaller. On the other hand, if the magnitude of the tension of the nonwoven fabric 3 is smaller than the desired value, the dancer roller 38*dn* moves so that the loop L3*dn* becomes larger. The driven roll 38*k* is driven and rotated by a servo motor, and the servo motor rotates the driven roll 38*k* so that the size of the loop L3*dn* is a predetermined value. The nonwoven fabric 3 is consequently fed out. For example, if the size of the loop L3*dn* is greater than the predetermined value, the circumferential speed value (m/min.) of the driven roll 38*k* decreases. On the other hand, if the size of the loop L3*dn* is smaller than the predetermined value, the circumferential speed value (m/min.) of the driven roll 38*k* increases. Accordingly, the magnitude of the tension of the nonwoven fabric 3 at a position immediately downstream from the tension controller 38 is adjusted to be the desired value.

The heating section 60 includes: a heating unit 61 that blows hot air to the nonwoven fabric 3 to heat the nonwoven fabric 3 while the nonwoven fabric 3 passing therein; and a hot-air generator 67 that supplies hot air to the heating unit 61. The heating unit 61 includes: a case member 62 having openings at both ends in the longitudinal direction; and a plurality of guide rollers 64, 64, and 64 that are provided outside the case member 62 and guide the nonwoven fabric 3 in the case member 62 so that the nonwoven fabric 3 reciprocally move. Inside the case member 62, a straight forward path and a straight return path of the conveying path of the nonwoven fabric 3 are formed by the guide rollers 64, 64, and 64. As shown in FIG. 3A, the case member 62 has a wall member 63 therein, and the wall member 63 partitions an inner space of the case member 62 into a forward-path space SP62*a* and a return-path space SP62*b*. That is, the forward-path space SP62*a* and the return-path space SP62*b* are isolated from each other in such a manner that air cannot transfer therebetween. As a result of isolation by the wall member 63, an inlet 62*ain* for the forward path of the nonwoven fabric 3 and an outlet 62*bout* for the return path of the same are formed on one longitudinal end of the case member 62. Similarly, on the other longitudinal end, an outlet 62*aout* for the forward path of the nonwoven fabric 3 and an inlet 62*bin* for the return path of the same are formed.

The wall member 63 has two walls 63*wa* and 63*wb*; the wall 63*wa* is adjacent to the forward-path space SP62*a* (hereinafter referred to as a forward-path wall 63*wa*), and the wall 63*wb* is adjacent to the return-path space SP62*b* (hereinafter referred to as a return-path wall 63*wb*). These walls 63*wa* and 63*wb* are parallel to the conveying direction and the CD direction, and thus the forward-path wall 63*wa* and the return-path wall 63*wb* are substantially parallel to the surfaces of the nonwoven fabric 3. A slit-like jet inlet 63Na elongated in the CD direction is provided in an upstream portion of the forward-path wall 63*wa* in the forward path (corresponding to "the inlet-side portion of the case member"). Also, a slit-like jet inlet 63Nb elongated in the CD direction is provided in an upstream portion of the return-path wall 63*wb* in the return path (corresponding to "the inlet-side portion of the case member").

More specifically speaking, the wall member 63 has the pressure chambers R63*a* and R63*b* corresponding to the foregoing portions. To the pressure chambers R63*a* and R63*b*, hot air is supplied from the hot-air generator 67. Each of the pressure chambers R63*a* and R63*b* has a tapered cross section (the normal direction is the CD direction) in which the diameter is substantially reduced toward downstream in the conveying direction. At the tip end of the tapered shape, the pressure chambers R63*a* and R63*b* respectively communicate with the space SP62*a* for forward path and the space SP62*b* for return path. Thus, the tip ends respectively serves as the foregoing jet inlets 63Na and 63Nb. The jet inlets 63Na and 63Nb face one of two surfaces of the nonwoven fabric 3, and blasts hot air toward downstream in the conveying direction at an acute angle θ to the surface.

Thus, hot air which has been blasted from the jet inlet 63Na for the forward path comes into contact with the surface of the nonwoven fabric 3 at a component of velocity toward downstream in the conveying direction. Then, the hot air flows, as it is, on the surface of the nonwoven fabric 3, and is evacuated outside from the outlet 62*aout* (corresponding to the evacuation opening), which is located most downstream in the forward-path space SP62*a* in the conveying direction. Hot air which has been blasted from the jet inlet 63Nb for the return path comes into contact with the surface of the nonwoven fabric 3 at a component of velocity toward downstream in the conveying direction. Then, the hot air flows, as it is, on the surface of the nonwoven fabric 3, and is evacuated outside from the outlet 62*bout* (corresponding to the evacuation opening), which is located most downstream in the return-path space SP62*b* in the conveying direction.

Since hot air flows on the surface of the nonwoven fabric 3 and moves in the foregoing manner, hot air effectively avoid compressing the nonwoven fabric 3 from the thickness direction of the nonwoven fabric 3. This makes it possible to smoothly recover bulkiness.

Depending adjustment of the volume ($m^3$/min.) of hot air, the speed value of air flow Vw (m/min.) of hot air can be larger than the conveying speed value V3 (m/min.) of the nonwoven fabric 3. In this case, hot air which has been blasted from the jet inlets 63Na and 63Nb overtakes the nonwoven fabric 3 so as to slide along the surface of the nonwoven fabric 3, and is finally evacuated outside from the outlets 62*aout* and 62*bout*. Accordingly, based on the relative speed difference between hot air and the nonwoven fabric 3, the hot air can surely become turbulent. This can dramatically improve heat transfer efficiency and the nonwoven fabric 3 can be efficiently heated to quickly recover its bulkiness. In addition, since turbulent hot air loosens fibers of the nonwoven fabric 3 at random, this facilitates recovery of the bulkiness.

The speed value of air flow Vw (m/min.) of hot air is a value obtained by dividing, for example, the volume ($m^3$/min.) of hot air supplied to the forward-path space SP62*a* or the return-path space SP62*b* by the cross section of the forward-path space SP62*a* or the return-path space SP62*b* (that is, an area of the cross section whose normal direction is the conveying direction).

It is preferable that the foregoing relationship between the speed value of air flow Vw and the conveying speed value V3 is established through the entire lengths of the forward-path space SP62*a* and the return-path space SP62*b* in the conveying direction. However, it is not necessary that the relationship is established through their entire lengths. In other words, if the foregoing relationship is established in parts of the spaces SP62*a* and SP62*b*, effects according to the foregoing turbulence can be relatively achieved.

The jet inlet 63Na for the forward path and the jet inlet 63Nb for the return path each have a rectangular shape the longitudinal direction of which is in the CD direction. The dimension of the forward-path jet inlet 63Na in the CD direction is equal to the dimension of the forward-path space SP62*a* in the CD direction, and the dimension of the return-path jet inlet 63Nb in the CD direction is equal to the dimension of the return-path space SP62*b* in the CD direction. However, the invention is not limited thereto. For example, the jet inlets 63Na and 63Nb may be smaller. But, it is preferable that the dimensions of the jet inlets 63Na and 63Nb in the CD direction are larger than the widthwise dimension of the nonwoven fabric 3 (the dimension in the CD direction). This suppresses heating unevenness in the CD direction.

The dimensions of the jet inlets 63Na and 63Nb in the lateral direction (the dimensions in a direction perpendicular to the longitudinal direction) are selected and set to values within a range, for example, from 1 min to 10 mm.

It is preferable that the angle θ between the conveying direction of the nonwoven fabric 3 and a direction in which hot air is blasted at the positions of the jet inlets 63Na and 63Nb is within a range from 0° to 30°. It is more preferable that the angle θ is within a range from 0° to 10° (FIG. 3A). This allows hot air to flow reliably along the surface of the nonwoven fabric 3.

In the example of FIG. 2, the heating unit 61 is a unit to be installed in horizontal orientation, in which the longitudinal direction of the case member 62 is in the horizontal direction. Accordingly, the forward path and the return path for the conveying path of the nonwoven fabric 3 are horizontal. However, the invention is not limited thereto. In some cases, the heating unit 61 may be a unit to be installed in vertical orientation. More specifically, it is acceptable that the longitudinal direction of the case member 62 is in the vertical direction and that the forward path and the return path for the conveying path of the nonwoven fabric 3 are vertical. Further, depending on the arrangement of apparatus, the case member 62 may be installed in a state that its longitudinal direction is tilted to the vertical direction and the horizontal direction. But, a vertical-oriented unit has an advantage that it is possible to save a horizontal space necessary to install the heating unit 61.

As shown in FIG. 3A, hot-air generator 67 includes a blower 67*b* and a heater 67*h*. The heater 67*h* heats air which has been generated by the blower 67*b*, and thereby hot air is generated. Through a suitable pipe member 67*p*, the hot air is supplied to the pressure chambers R63*a* and R63*b* of the wall member 63 in the case member 62 according to the foregoing heating unit 61. The hot air is blasted from the jet inlets 63Na and 63Nb through the pressure chambers R63*a* and R63*b*.

The blower 67*b* includes, for example: an impeller 67*i* which rotates a motor as a driving source; and an inverter (not shown) which adjusts the revolutions (rpm) of the motor. Thus, the controller to be described later can control a VVVF inverter, and consequently can adjust the volume ($m^3$/min.) to any value by changing the revolutions (rpm) of the impeller 67*i*.

The heater is, for example, an electric heater which heats things using electric power (kW). By changing the amount of power delivered to the heater, the temperature of the hot air can be adjusted to any value. It is preferable that the temperature of the hot air at the jet inlets 63Na and 63Nb is set to be lower than the melting point of thermoplastic resin fiber contained the nonwoven fabric 3 and to be equal to or higher than a temperature of 50° C. below the melting point of the thermoplastic resin fiber. This makes it possible to reliably recover the bulkiness of the nonwoven fabric 3 as well as to suppress melting of thermoplastic resin fiber.

As shown in FIG. 3A, the heater 67*h* may be provided inside the blower 67*b*, or may be provided outside the blower 67*b*. If the heater 67*h* is provided outside the blower 67*b*, it is preferable that the heaters 67*ha* and 67*hb* are placed close to the case member 62 of the heating unit 61 as virtually indicated by double-dotted chain lines in FIG. 3A. This makes it possible to increase its response when adjusting the temperature of the hot air. In this case, it is more preferable that the heaters 67*ha* and 67*hb* are respectively provided for the jet inlets 63Na and 63Nb. In other words, it is preferable that the heater 67*ha* is provided for the forward-path jet inlet 63Na and the heater 67*hb* is provided for the return-path jet inlet 63Nb. This makes it possible to adjust the temperature of the hot air individually for each of the jet inlets 63Na and 63Nb. Consequently, conditions for recovering bulkiness can be set more finely.

The heaters 67*h*, 67*ha* and 67*hb* are not limited to electric heaters. Anything which can heat air flow may be applied.

In this example, though the term "air flow" means flow of air, the term also includes in the wider sense flow of gas such nitrogen gas and inert gases. That is, nitrogen gas and the like may be blown from the jet inlets 63Na and 63Nb.

A controller (not shown) is, for example, a computer or a programmable logic controller (PLC), and includes a processor and a memory. The processor reads and executes a control program stored in advance in the memory, and thereby the conveying section 30 and the heating section 60 are controlled.

In this example, the controller controls the upstream conveyor driven roller 32*u* and the downstream conveyor driven roller 32*d* included in the conveying section 30 (FIG. 2) so that the nonwoven fabric 3 is being conveyed in the heating unit 61 in a predetermined conveying state. More specifically, the controller controls servo motors so as to keep constant the ratio R of the circumferential speed value V32*u* of the upstream conveyor driven roller 32*u* (m/min.) to the circumferential speed value V32*d* of the downstream conveyor driven roller 32*d* (m/min.). The ratio R is a value R obtained by dividing the circumferential speed value V32*u* of the upstream conveyor driven roller 32*u* by the circumferential speed value V32*d* of the downstream conveyor driven roller 32*d* (=V32*u*/V32*d*).

If the ratio R is 1 (R=1), the circumferential speed value V32*u* of the upstream conveyor driven roller 32*u* is controlled so as to be equal to the circumferential speed value V32*d* of the downstream conveyor driven roller 32*d*. If the ratio R is greater than 1 (R>1), the circumferential speed value V32*u* of the upstream conveyor driven roller 32*u* is controlled so as to be greater than the circumferential speed value V32*d* of the downstream conveyor driven roller 32*d*. On the other hand, if the ratio R is smaller than 1 (R<1), the circumferential speed value V32*u* of the upstream conveyor driven roller 32*u* is controlled so as to be smaller than the circumferential speed value V32*d* of the downstream conveyor driven roller 32*d*.

If the ratio R<1, in other words, if the circumferential speed value V32*u* of the upstream conveyor driven roller 32*u* is smaller than the circumferential speed value V32*d* of the downstream conveyor driven roller 32*d*, the nonwoven fabric 3 is conveyed while being pulled toward downstream. Accordingly, it can be considered that the nonwoven fabric 3 is conveyed without any trouble. On the other hand, if the ratio R>1, in other words, the circumferential speed value V32*u* of the upstream conveyor driven roller 32*u* is greater than the circumferential speed value V32*d* of the downstream conveyor driven roller 32*d*, it merely can be considered that the nonwoven fabric 3 cannot be conveyed because the nonwoven fabric 3 is loosened in the heating unit 61. However, on this point, since the nonwoven fabric 3 has shrunk by being heated, its sagging is quickly absorbed.

Consequently, even if the ratio R>1, the nonwoven fabric 3 is actually conveyed without any trouble.

In the bulkiness recovery apparatus 20 according to this embodiment, it is possible that the variation in the widthwise dimension of the nonwoven fabric 3 increase because the nonwoven fabric 3 which has been heated the heating unit 61 becomes softened. That is, when tension in the conveying direction is exerted on the softened nonwoven fabric 3, the widthwise dimension of the nonwoven fabric 3 will be easily able to vary due to strength unevenness of the nonwoven fabric 3 and the like. On the other hand, the magnitude of the tension of the nonwoven fabric 3 can be changed by the conveying section 30. In this embodiment, in order to suppress the variation in the widthwise dimension, the controller controls the conveying section 30. This will be described below.

As shown in FIG. 2, at a position downstream from the heating unit 61 of the heating section 60, a width sensor 70 is provided for detecting the variation in the widthwise dimension. That is, the width sensor 70 measures the widthwise dimension of the nonwoven fabric 3 at the foregoing position, and outputs information concerning the widthwise dimension. The information contains a value varying in conjunction with the widthwise dimension of the nonwoven fabric 3. In this example, the information contains a value varying in proportion to the widthwise dimension of the nonwoven fabric 3.

Figure 4:
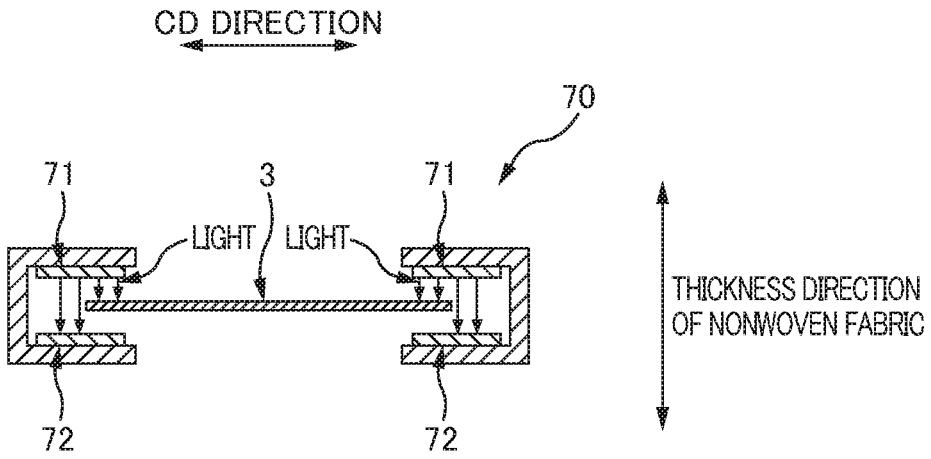
FIG. 4 is a diagram illustrating a width sensor 70.

FIG. 4 is a diagram illustrating the width sensor 70. As shown in FIG. 4, as an example of the width sensor 70, a configuration having a light-emitting part 71 and a light-receiving part 72 can be provided; the light-emitting part 71 emits light, and the light-receiving part 72 receives light emitted by the light-emitting part 71. The light-emitting part 71 and the light-receiving part 72 are placed facing each other respectively on opposite sides of the nonwoven fabric 3 in the thickness direction. The light-receiving part 72 is, for example, a one-dimensional CCD image sensor in which a plurality of charge-coupled devices (CCDs) are aligned in the CD direction, and this image sensor outputs signals each having an amplitude according to the number of CCDs which receives light. The number of light-receiving CCDs varies depending on the size of an area which is protected by the nonwoven fabric 3 from light. Accordingly, information indicating the widthwise dimension can be generated from the foregoing signals, and the generated information is output to the controller in real time.

On the other hand, the desired value of the widthwise dimension of the nonwoven fabric 3 is stored in advance in a memory of the controller. The controller calculates the value of the widthwise dimension based on information output from the width sensor 70, and compares the desired value with the calculated value of the dimension, which is considered as the actual value of the widthwise dimension. Then, based on information from the comparison result, the controller controls rotations of the upstream conveyor driven roller 32*u* and the downstream conveyor driven roller 32*d* of the conveying section 30. As an example of the information from the comparison result, the difference value Δ obtained by merely subtracting the desired value from the actual value (=the actual value−the desired value) can be provided, for example. This value is used in this example.

The controller executes a process of calculating the difference value Δ (the abovementioned comparing process) at a predetermined control period (millisecond). At every time of calculating the difference value Δ, the controller changes the ratio R of the foregoing circumferential speed value, based on the difference value Δ. For example, if the difference value Δ is a negative value, the controller adds a predetermined value to the current value of the ratio R, and thereby changes the ratio R so that the ratio R is larger than the current value. Then, if the circumferential speed value V32*d* of the downstream conveyor driven roller 32*d* is kept constant (in other words, if the circumferential speed value V32*d* of the downstream conveyor driven roller 32*d* is not changed), the ratio R is changed in a direction in which the circumferential speed value V32*u* of the upstream conveyor driven roller 32*u* only increases. Accordingly, since the tension of the nonwoven fabric 3 in the conveying direction decreases, the widthwise dimension of the nonwoven fabric 3 increases. Consequently, adjustment is performed in a direction in which the difference value Δ becomes zero, that is, a direction in which the widthwise dimension approaches the desired value.

On the other hand, if the difference value Δ is a positive value, for example, the controller subtracts a predetermined value from the current value of the ratio R, and thereby changes the ratio R so that the ratio R is smaller than the current value. Then, if the circumferential speed value V32*d* of the downstream conveyor driven roller 32*d* is kept constant (in other words, if the circumferential speed value V32*d* of the downstream conveyor driven roller 32*d* is not changed), the ratio R is changed in a direction in which the circumferential speed value V32*u* of the upstream conveyor driven roller 32*u* only decreases. Accordingly, since the tension of the nonwoven fabric 3 in the conveying direction increases, the widthwise dimension of the nonwoven fabric 3 decreases. Consequently, adjustment is performed in a direction in which the difference value Δ becomes zero, that is, a direction in which the widthwise dimension approaches the desired value.

In some cases, another controlling may be applied. That is, the circumferential speed value V32*u* of the upstream conveyor driven roller 32*u* and the circumferential speed value V32*d* of the downstream conveyor driven roller 32*d* may be changed at once while the ratio R being kept constant, based on the information which has been output from the width sensor 70. For example, if the difference value Δ is a negative value, the controller increases both circumferential speed values V32*u* and V32*d* while the ratio R being kept constant. This shortens a period during which the nonwoven fabric 3 is passing the heating unit 61, and therefore softening the nonwoven fabric 3 is suppressed. Thus, the widthwise dimension of the nonwoven fabric 3 increases, and the widthwise dimension consequently approaches the desired value. On the other hand, if the difference value Δ is a positive value, the controller decreases both circumferential speed values V32*u* and V32*d* while the ratio R being kept constant. This shortens a period during which the nonwoven fabric 3 is passing the heating unit 61, and therefore softening the nonwoven fabric 3 proceeds. Thus, the widthwise dimension of the nonwoven fabric 3 decreases, and the widthwise dimension consequently approaches the desired value.

In this method, the variation in the widthwise dimension caused by other causes can be suppressed. That is, in some cases, the widthwise dimension of the nonwoven fabric 3 may vary because the variation in the tension of the nonwoven fabric 3 occurs at a position downstream from downstream conveyor driven roller 32*d*. This method can effectively suppress the foregoing variation.

In some cases, based on the information which has been output from the width sensor 70, the temperature of the hot air may be changed. For example, if the difference value Δ calculated based on the information is a negative value, the controller decreases the amount of power delivered to the heater 67*h* of the hot-air generator 67 of the heating section 60, to lower the temperature of the hot air. Accordingly, softening the nonwoven fabric 3 is suppressed, and the widthwise dimension of the nonwoven fabric 3 consequently approaches the desired value. On the other hand, if the difference value Δ is a positive value, the controller increases the amount of power delivered to the heater 67*h*, to raise the temperature of the hot air. Accordingly, softening the nonwoven fabric 3 proceeds, and the widthwise dimension of the nonwoven fabric 3 consequently approaches the desired value.

If the speed value of air flow Vw (m/min.) of hot air is greater than the conveying speed value V3 (m/min.) of the nonwoven fabric 3, the volume ($m^3$/min.) of hot air may be changed based on the foregoing information output from the width sensor 70. For example, in this example, the speed value of air flow Vw is in a range from 1000 to 3000 (m/min.), and the conveying speed value V3 is in a range from 100 to 500 (m/min.). That is, the speed value of air flow Vw is significantly greater than the conveying speed value V3. In this case, tractional force by hot air is exerted in a direction in which the tension of the nonwoven fabric 3 increases by pulling the nonwoven fabric 3 in the conveying direction. Thus, if the volume decreases, the tractional force 3 decreases and the tension of the nonwoven fabric 3 also decreases. Consequently, the widthwise dimension of the nonwoven fabric 3 can increase. On the other hand, if the volume increases, the tractional force increases and the tension of the nonwoven fabric 3 also increases. Consequently, the widthwise dimension of the nonwoven fabric 3 can decrease.

If the difference value Δ is a negative value, the controller decreases the revolutions (rpm) of the impeller 67*i* of the blower 67*b* in order to decrease tractional force of hot air. Then, the tractional force of hot air which is exerted on the nonwoven fabric 3 becomes smaller, and the tension of the nonwoven fabric 3 is accordingly small. Consequently, the widthwise dimension of the nonwoven fabric 3 becomes larger and approaches the desired value. On the other hand, if the difference value Δ is a positive value, the controller increases the revolutions (rpm) of the impeller 67*i* in order to increase the volume of hot air. Then, the tractional force of hot air becomes greater, and the tension of the nonwoven fabric 3 is accordingly great. Consequently, the widthwise dimension of the nonwoven fabric 3 becomes smaller and approaches the desired value.

Either one of the temperature of hot air and the volume of hot air may be changed, or both of them may be changed. Changing the temperature of hot air or the volume of hot air may be combined with either one of the following changes: change of the ratio R between the circumferential speed values V32*u* and V32*d*; and change of the circumferential speed values V32*u* and V32*d* under a constant ratio R.

Other Embodiments

While the embodiments of the invention are described above, the embodiments are for the purpose of elucidating the understanding of the invention and are not to be interpreted as limiting the invention. The invention can of course be altered and improved without departing from the gist thereof, and equivalents are intended to be embraced therein.

In the foregoing embodiments, the nonwoven fabric 3 for the top sheet 3 of the pet pad 1 is described as an example of workpiece to be processed by the bulkiness recovery apparatus 20. However, the invention is not limited thereto. For example, the invention may be applied to nonwoven fabric for the top sheet of a sanitary napkin, and may also be applied to nonwoven fabric for the top sheet of a diaper. And, the bulkiness recovery apparatus 20 is not limited to the nonwoven fabric 3 for the top sheet 3. That is, nonwoven fabric for any other component which needs to have bulkiness may be processed by the bulkiness recovery apparatus 20 according to the invention.

In the foregoing embodiments, as shown in FIG. 1B, as an example of the nonwoven fabric 3 for the top sheet 3, the nonwoven fabric 3 having a plurality of straight protrusions 3*p*, 3*p*, . . . on one surface thereof is described. However, the invention is not limited thereto. For example, the invention may be applied to normal nonwoven fabric, in other words, nonwoven fabric both surfaces of which are substantially flat.

In the foregoing embodiments, as shown in FIG. 2, the heating unit 61 of the heating section 60 heats the nonwoven fabric 3 in both of the forward path and the return path. However, the invention is not limited thereto. For example, if heating in either one of the forward path and the return path is sufficient to recover bulkiness, either one of the jet inlet 63Na for the forward path and the jet inlet 63Nb for the return path may be omitted. On the other hand, if heating in two paths, the forward path and the return path, is not sufficient to recover bulkiness, a plurality of the heating units 61 may be provided to heat the nonwoven fabric 3 in three or more paths. It is preferable that the jet inlets 63Na and 63Nb are provided for each of the forward path and the return path. This is because the longitudinal dimension of the heating unit 61 can be reduced and at the same time the conveying path of the nonwoven fabric 3 can have a length necessary to recover bulkiness of the nonwoven fabric 3.

In the foregoing embodiments, as shown in FIGS. 3A and 3B, the heating unit 61 is not one of an existing, air-through type heating unit. However, the invention is not limited thereto. That is, an existing, air-through type heating unit may be employed. It should be noted that an existing, air-through type heating unit is, for example, as follow. The heating unit includes: jet inlets for hot air provided facing one of two surfaces of the nonwoven fabric 3 which is conveyed along the conveying direction; and suction openings for hot air provided facing the other surface. These jet inlets and suction openings forms a streamline along which suction openings suck hot air blasted from the jet inlets, and thereby hot air passes through the nonwoven fabric 3 in its thickness direction, to heat the nonwoven fabric 3.

As an example of conveying mechanism which conveys the nonwoven fabric 3 in the conveying direction, a suction belt conveyor and a suction drum can be provided. Such a suction belt conveyor conveys the nonwoven fabric 3 which is placed on the outer circumferential face of an endless belt, the endless belt being driven and rotated. The outer circumferential face has a plurality of air inlet holes, which serve as the foregoing suction opening sucking hot air. Such a suction drum conveys the nonwoven fabric 3 which is wound around the outer circumferential face of a rotary drum, the rotary drum being driven and rotated. The outer circumferential face has a plurality of air inlet holes, which serve as the foregoing suction opening sucking hot air.

Figure 5:
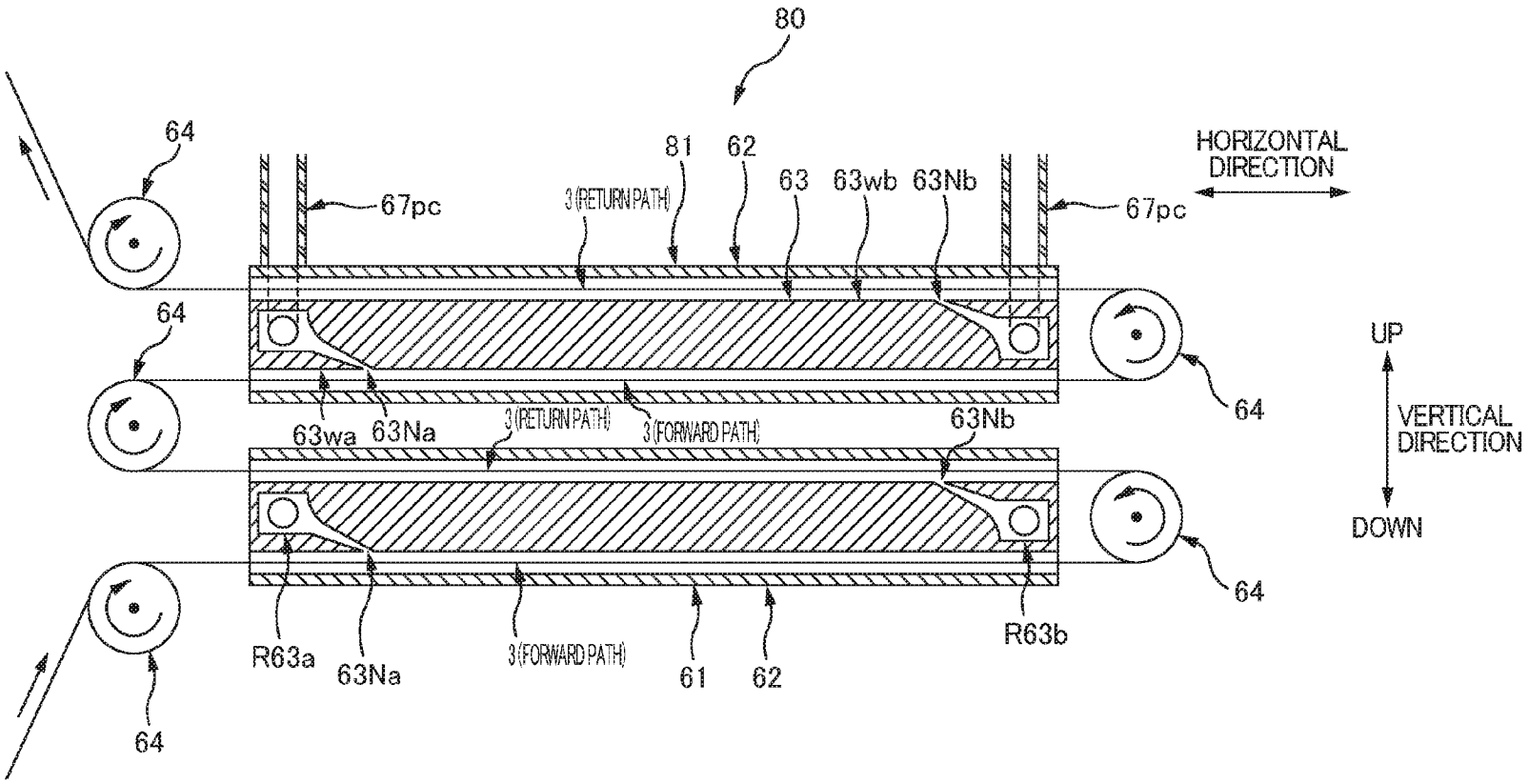
FIG. 5 is a schematic cross sectional view of a cooling unit 81, which is provided immediately downstream from a heating unit 61.

In the foregoing embodiments, it can be said that the nonwoven fabric 3 which has passed the heating unit 61 of the heating section 60 is spontaneously cooled. But, in some cases, as shown in FIG. 5, a cooling section 80 which cools the nonwoven fabric 3 may be provided at a position immediately downstream from the heating unit 61. Specifically speaking, the cooling section 80 is provided at a position immediately downstream from the heating unit 61, and includes: a cooling unit 81 which blows cooling-purpose air to the nonwoven fabric 3 to cool the nonwoven fabric 3; and an air-flow supplier (not shown) which supplies cooling-purpose air to the cooling unit 81.

If the nonwoven fabric 3 is cooled by cooling-purpose air blasted from the cooling unit 81, it is possible to effectively prevent the following phenomenon that will be caused by high temperature of the nonwoven fabric 3 which has been heated by the heating unit 61: a phenomenon that the widthwise dimension of the nonwoven fabric 3 varies because the nonwoven fabric 3 has been softened.

As an example of the cooling unit 81, a configuration similar to the foregoing heating unit 61 can be provided. That is, the cooling unit 81 includes, like the heating unit 61, the case member 62, the wall member 63, and the guide rollers 64, 64, and 64. But, from each of slit-like jet inlets 63Na and 63Nb provided in walls 63*wa* and 63*wb* of the wall member 63, air the temperature of which is sufficiently low to cool the nonwoven fabric 3 is blasted. That is, cool air the temperature of which is equal to or lower than room temperature is supplied to the jet inlets 63Na and 63Nb from the foregoing air-flow supplier through suitable pipe members 67*pc*. Accordingly, the air-flow supplier includes at least a blower, more preferably, a cooler which cools air flow generated by the blower. The air can cool the nonwoven fabric 3 if its temperature is lower than the temperature of the nonwoven fabric 3 immediately after the fabric 3 has been discharged from the case member 62 of the heating unit 61. Accordingly, the temperature of the air may be higher than room temperature (20° C.±15° C.), for example, any value within a range of 5° C.-50° C. With the cooling unit 81 having the foregoing configuration, cooling-purpose air which has been blasted from the jet inlets 63Na and 63Nb flows on the surface of the nonwoven fabric 3, the nonwoven fabric 3 can be effectively prevented from being compressed in the thickness direction. Accordingly, the recovered bulkiness effectively avoids being compressed by the air flow.

In the foregoing embodiments, hot air which has flown in forward-path space SP62*a* or return-path space SP62*b* is evacuated, as it is, from the corresponding outlets 62*aout* and 62*bout* of the case member 62 for the nonwoven fabric 3 (FIG. 3A). Taking into consideration energy recycling and taking into consideration reduction of adverse effects by hot air to its vicinity and other in-process material, hot air which has flown in the spaces SP62*a* and SP62*b* may be reclaimed and returned to an intake-side part 67*bs* of the blower 67*b*. For example, as shown in the schematic cross sectional view of FIG. 6, openings 63*ha* and 63*hb* are provided in a downstream part of the wall member 63 in the conveying direction, and one of end openings of a reclaiming pipe member 69 is connected to the openings 63*ha* and 63*hb*. Thus, a space inside the pipe member 69 communicates with at least either one of a downstream end SP62*ae* of the forward-path space SP62*a* and a downstream end SP62*be* of the return-path space SP62*b*. And, the other end openings of the pipe member 69 may communicate with the intake-side part 67*bs* of the blower 67*b*.

Figure 6:
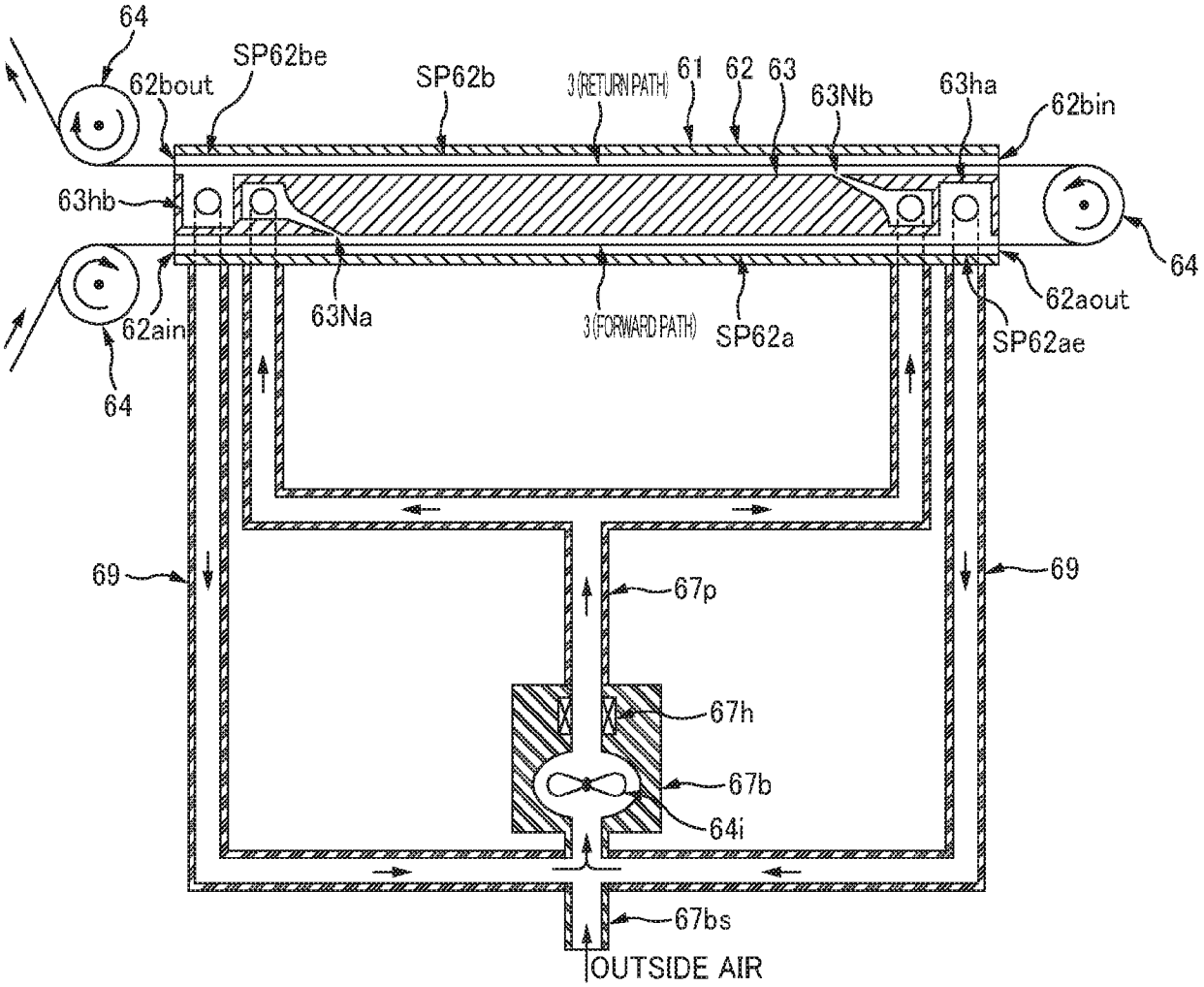
FIG. 6 is a schematic cross sectional view of a configuration in which hot air which has flown in a space SP62*a* for forward path and a space SP62*b* for return path is reclaimed and returned to an intake-side part 67*bs* of a blower 67*b*.

In the example of FIG. 6, there is a possibility that foreign matter such as fiber waste of the nonwoven fabric 3 is transferred to the heater 67*h* of the blower 67*b* through the reclaiming pipe member 69 and is fused to the heater 67*h*. It is therefore preferable that, for example, a mesh filter which prevents specific types of foreign matter from being sucked is placed between the intake-side part 67*bs* of the blower 67*b* and the reclaiming pipe member 69. Also, in the example of FIG. 3A, there is a possibility that foreign matter such as paper dust in the manufacturing line is sucked from the intake-side part 67*bs* together with outside air. It is therefore preferable that a filter of a similar type is provided in the intake-side part 67*bs*.

In the foregoing embodiments, as shown in FIG. 3A, the jet inlet 63Na for the forward path the is provided in an upstream part of the forward-path wall 63*wa* in the forward path, and the jet inlet 63Nb for the return path is provided in an upstream part of the return-path wall 63*wb* in the return path. However, the invention is not limited thereto.

For example, the jet inlet 63Na for the forward path may be provided in a downstream part of the forward-path wall 63*wa* in the forward path (corresponding to "the outlet-side portion of the case member") and the jet inlet 63Nb for the return path may be provided in downstream part of the return-path wall 63*wb* in the return path (corresponding to "the outlet-side portion of the case member"). In this case, both of the jet inlet 63Na for the forward path and the jet inlet 63Nb for return path are formed so that the jet inlets 63Na and 63Nb blast hot air toward upstream in the conveying direction at an acute angle to one of two surfaces of the nonwoven fabric 3. Accordingly, hot air which has been blasted from the jet inlet 63Na for the forward path comes into contact with the surface of the nonwoven fabric 3 at a component of velocity toward upstream in the conveying direction. Then, the hot air flows, as it is, upstream on the surface of the nonwoven fabric 3, and finally is evacuated outside from the inlet 62*ain* for the forward path, which is located most upstream in the forward-path space SP62*a*. Hot air which has been blasted from the jet inlet 63Nb for the return path comes into contact with the surface of the nonwoven fabric 3 at a component of velocity toward upstream in the conveying direction. Then, the hot air flows, as it is, upstream the surface of the nonwoven fabric 3, and is evacuated outside from the inlet 62*bin* for the return path, which is located most upstream in the return-path space SP62*b* in the conveying direction. The same applies to the foregoing cooling unit 81.

In the foregoing embodiments, the wall member 63 is made of a solid member which basically has no space inside it except for the pressure chambers R63*a* and R63*b*. However, the invention is not limited thereto. For example, a hollow member having a space inside it may be used for the purpose of light weight. An example of such a hollow member is as follow: a combined member including a stainless plate member serving as the forward-path wall 63*wa* in FIG. 3A, a stainless plate member serving as the return-path wall 63*wb*, and a prism member which is placed between and connects these plate members. Note that these members are not shown in FIG. 3A.

In the foregoing embodiments, the width sensor 70 including the light-emitting part 71 and the light-receiving part 72 is described as an example (FIG. 4). However, the invention is not limited thereto. For example, the widthwise dimension may be measured with a suitable camera. That is, the following configuration may be employed: the widthwise ends of the nonwoven fabric 3 are imaged by a CCD camera at a suitable control period, the image data of the widthwise ends is generated, the positions of the widthwise ends in the CD direction are obtained by means such as binarization of the image data, and information concerning the widthwise dimension is output based on the positions.

REFERENCE SIGNS LIST

1 pet pad (absorbent article),
3 top sheet (nonwoven fabric), 3R nonwoven-fabric web,

3*a* surface, 3*b* surface, 3*e* edge,
3*t* groove, 3*p* protrusion, 3*h* through hole,
3*es* edge, See edge,
4 absorbent body, 4*c* absorbent core,
4*t*1 cover sheet, 4*t*2 cover sheet,
5 back sheet,
20 bulkiness recovery apparatus,
30 conveying section,
32 conveyor roller,
32*u* upstream conveyor driven roller, 32*d* downstream conveyor driven roller,
35 feeding unit,
36 material-splicing apparatus,
37 accumulator,
37*m* movable roller, G37*m* movable-roller group,
37*s* fixed roller, G37*s* fixed-roller group,
38 tension controller,
38*dn* dancer roller, 38*k* driven roll, 38*s* fixed roll,
60 heating section, 61 heating unit, 62 case member,
62*ain* inlet, 62*aout* outlet (evacuation opening),
62*bin* inlet, 62*bout* outlet (evacuation opening),
63 wall member,
63Na jet inlet for forward path, 63Nb jet inlet for return path,
63*ha* opening, 63*hb* opening,
63*wa* forward-path wall, 63*wb* return-path wall,
64 guide rollers,
67 hot-air generator,
67*b* blower, 67*bs* intake-side part,
67*h* heater, 67*ha* heater, 67*hb* heater,
67*i* impeller, 67*p* pipe member, 67*pc* pipe member, 69 reclaiming pipe member,
70 width sensor,
71 light-emitting part, 72 light-receiving part,
80 cooling section, 81 cooling unit,
SP62*a* forward-path space, SP62*ae* downstream end,
SP62*b* return-path space, SP62*be* downstream end,
R63*a* pressure chamber, R63*b* pressure chamber,
L3 loop, L3*dn* loop,

The invention claimed is:

1. An apparatus for recovering bulkiness of nonwoven fabric by blowing hot air to heat the nonwoven fabric, the apparatus comprising:

a conveying section that conveys the nonwoven fabric along a conveying direction, the nonwoven fabric being continuous in the conveying direction;

a heating section that heats the nonwoven fabric by blowing the hot air to the nonwoven fabric being conveyed;

a width sensor that measures a widthwise dimension of the nonwoven fabric at a position downstream from the heating section in the conveying direction, and that outputs information concerning the widthwise dimension; and a controller that controls at least either one of the heating section and the conveying section based on the information that has been output from the width sensor, wherein the conveying section conveys the nonwoven fabric along a predetermined conveying path, the conveying section includes a first driven roller located in the conveying path at a first end of the heating section in the conveying direction, and a second driven roller located in the conveying path at a second end of the heating section in the conveying direction, the first and second driven rollers being driven and rotated for conveying the nonwoven fabric, the first driven roller is located upstream of the second driven roller in the conveying direction, and the controller changes a circumferential speed value of the first driven roller based on the information that has been output from the width sensor.

2. The apparatus according to claim 1, wherein the controller changes a ratio of a circumferential speed value of one driven roller of the first and second driven rollers to a circumferential speed value of the other driven roller of the first and second driven rollers.

3. The apparatus according to claim 1, wherein the position at which the width sensor measures the widthwise dimension of the nonwoven fabric is a position in the conveying path between the heating section and the second driven roller located downstream of the first driven roller.

4. The apparatus according to claim 1, wherein the heating section includes a case member having an inlet for the nonwoven fabric and an outlet for the nonwoven fabric, either one of an inlet-side portion and an outlet-side portion of the case member has a jet inlet, the jet inlet blasting the hot air to an inner space of the case member toward the other one of the inlet-side portion and the outlet-side portion while the hot air is in contact with one of two surfaces of the nonwoven fabric, and the other one of the inlet-side portion and the outlet-side portion has an evacuation opening that evacuates the hot air from the case member.

5. The apparatus according to claim 1, further comprising a cooling section that cools the nonwoven fabric by blowing cooling-purpose air to the nonwoven fabric that has been heated by the heating section.

6. The apparatus according to claim 5, wherein the cooling section includes a case member having an inlet for the nonwoven fabric and an outlet for the nonwoven fabric, either one of an inlet-side portion and an outlet-side portion of the case member has a jet inlet, the jet inlet blasting the cooling-purpose air to an inner space of the case member toward the other one of the inlet-side portion and the outlet-side portion while the cooling-purpose air is in contact with one of two surfaces of the nonwoven fabric, and the other one of the inlet-side portion and the outlet-side portion has an evacuation opening that evacuates the cooling-purpose air from the case member.

7. An apparatus for recovering bulkiness of nonwoven fabric by blowing hot air to heat the nonwoven fabric, the apparatus comprising:

a conveying section that conveys the nonwoven fabric along a conveying direction, the nonwoven fabric being continuous in the conveying direction;

a heating section that heats the nonwoven fabric by blowing the hot air to the nonwoven fabric being conveyed;

a width sensor that measures a widthwise dimension of the nonwoven fabric at a position downstream from the heating section in the conveying direction, and that outputs information concerning the widthwise dimension; and a controller that controls at least either one of the heating section and the conveying section based on the information that has been output from the width sensor, wherein based on the information that has been output from the width sensor, the controller controls the heating section so as to change at least either one of a temperature of the hot air and a volume ($m^3$/min) of the hot air.

8. A method of recovering bulkiness of nonwoven fabric by blowing hot air to heat the nonwoven fabric, the method comprising:

conveying, by a conveying section, the nonwoven fabric along a conveying direction, the nonwoven fabric being continuous in the conveying direction;

heating, by a heating section, the nonwoven fabric by blowing the hot air to the nonwoven fabric being conveyed;

outputting, by a width sensor, information concerning a widthwise dimension of the nonwoven fabric having been heated by the hot air, by measuring the widthwise dimension at a position downstream from the heating section in the conveying direction; and adjusting, by a controller, at least either one of the conveying and the heating based on the information that has been output from the width sensor, wherein the conveying includes conveying the nonwoven fabric along a predetermined conveying path, the conveying section includes a first driven roller located in the conveying path at a first end of the heating section in the conveying direction, and a second driven roller located in the conveying path at a second end of the heating section in the conveying direction, the first and second driven rollers being driven and rotated for conveying the nonwoven fabric, the first driven roller is located upstream of the second driven roller in the conveying direction, and the controller changes a circumferential speed value of the first driven roller based on the information that has been output from the width sensor.

9. A method of recovering bulkiness of nonwoven fabric by blowing hot air to heat the nonwoven fabric, the method comprising:

conveying, by a conveying section, the nonwoven fabric along a conveying direction, the nonwoven fabric being continuous in the conveying direction;

heating, by a heating section, the nonwoven fabric by blowing the hot air to the nonwoven fabric being conveyed;

outputting, by a width sensor, information concerning a widthwise dimension of the nonwoven fabric having been heated by the hot air, by measuring the widthwise dimension at a position downstream from the heating section in the conveying direction; and adjusting, by a controller, at least either one of the conveying and the heating based on the information that has been output from the width sensor, wherein based on the information that has been output from the width sensor, the controller controls the heating section so as to change at least either one of a temperature of the hot air and a volume ($m^3$/min) of the hot air.

* * * * *